US006324798B1

(12) United States Patent
Kojima

(10) Patent No.: US 6,324,798 B1
(45) Date of Patent: Dec. 4, 2001

(54) ROOM INTERIOR PARTITION WITH LIGHTING FIXTURE

(75) Inventor: Masahiro Kojima, Tokyo (JP)

(73) Assignee: Weinberg Distribution Systems, Inc., Los Angeles, CA (US)

( * ) Notice: Subject to any disclaimer, the term of this patent is extended or adjusted under 35 U.S.C. 154(b) by 0 days.

(21) Appl. No.: 09/549,718

(22) Filed: Apr. 14, 2000

(51) Int. Cl.[7] ..... E04H 1/100

(52) U.S. Cl. ..... 52/239; 52/23.9; 52/36.1; 52/28

(58) Field of Search ..... 52/28, 29, 36.5, 52/241, 243, 239, 36.1, 173.1; D6/455

(56) References Cited

U.S. PATENT DOCUMENTS

D. 360,781 * 8/1995 Hill et al. ..... D6/455
4,161,850 * 7/1979 Peterson et al. ..... 52/65
5,291,700 * 3/1994 Chew ..... 52/36.1
5,930,963 * 8/1999 Nichols ..... 52/239
6,047,508 * 4/2000 Goodman et al. ..... 52/241

* cited by examiner

*Primary Examiner*—Carl D. Friedman
*Assistant Examiner*—Basil Katchenes
(74) *Attorney, Agent, or Firm*—Rothwell, Figg, Ernst & Manbeck

(57) ABSTRACT

Disclosed is a partition device that divides an original interior room into plural room sections which may be illuminated evenly and simultaneously by a common lighting fixture. This partition comprises one or more of wall panels (1, 2*a*–2*d*), connected to one another, which are upstanding from a floor toward a ceiling of an original room interior over a predetermined height. Each of the wall panels includes an opening 3, (4) along a common vertical axis. A single lighting fixture (5) is mounted within a space defined by cooperation of openings (3, 4) of the wall panels for illuminating, at the same time, all of room sections divided by the wall panels. The wall panels may comprise a main panel (1) and plural auxiliary panels (2*a*–2*d*) hinged to the center axis of the main panel.

5 Claims, 4 Drawing Sheets

ROOM INTERIOR PARTITION WITH LIGHTING FIXTURE

BACKGROUND OF THE INVENTION

1. Field of the Invention

The present invention relates to a room interior partition with a single lighting fixture which can illuminate each of room sections divided by the partition.

2. Description of the Prior Art

A partition has been used to divide a relatively large interior space into plural sections. The prior art partition usually comprises a desired combination of upstanding panels of desired height. The panel may extend from the floor to the ceiling for completely partitioning the original room interior. It may also have a full-body length or breast length from the floor. The panel may include an open frame with a hinged door. Adjacent two panels may be connected one another by suitable couplings to form an extensive wall panel of a required width. Each panel may be fixed to the floor directly or indirectly with supporting legs.

The original interior space has, of course, one or more of lighting fixtures on the ceiling or wall. When it is divided by the partitions into plural room sections, however, these lighting fixtures would not be capable of illuminating all of the divided room sections, even if the partitions do not have a full length from the floor to the ceiling. This requires that additional lighting fixtures are used to separately illuminate the divided room sections.

SUMMARY OF THE INVENTION

Accordingly, it is a principal object of the present invention to overcome the drawbacks and disadvantages of the conventional partitioning technique, and more particularly to provide a novel partition device dividing an original interior room into plural room sections which may be illuminated by a common lighting fixture attached to the partition.

In accordance with an aspect of the present invention, therefore, there is provided a room interior partition comprising one or more of wall panels, connected to one another, said wall panels being upstanding from a floor toward a ceiling of an original room interior over a predetermined height, each of said wall panels including an opening along a common vertical axis; and a single lighting fixture mounted within a space defined by cooperation of said openings of said wall panels for illuminating, at the same time, all of room sections divided by said wall panels.

In accordance with another aspect of the present invention, there is provided a room interior partition comprising at least one main wall panel with an opening along a predetermined vertical axis thereof, said main wall panel being upstanding from a floor toward a ceiling of an original room interior over a predetermined height; one or more of movable panels having one vertical edge pivottaly connected to the predetermined vertical axis of said main wall panel, each of said movable panels having a cutout along the connected vertical edge that cooperates with another cutout of an opposed movable panel to form an opening equivalent to said opening of said main panel; and a single lighting fixture mounted within a space defined by cooperation of said opening of said main wall panel and said cutouts of said movable panel for illuminating, at the same time, all of room sections divided by said main wall panel and movable panels.

In a preferable embodiment, each of said movable panels have width substantially a half of said main panel.

In another preferable embodiment, each of said movable panels is foldable onto one of opposite surfaces of said main panel.

In still another preferable embodiment, there are two main wall panels that intersect one another at right angles to divide the original room interior into four sections, between which at least one of said movable panels are respectively positioned.

BRIEF DESCRIPTION OF THE DRAWINGS

Other objects and advantages of the present invention can be understood from the following description when read in conjunction with the accompanying drawings in which.

DETAILED DESCRIPTION OF THE PREFERRED EMBODIMENT

Figure 1:
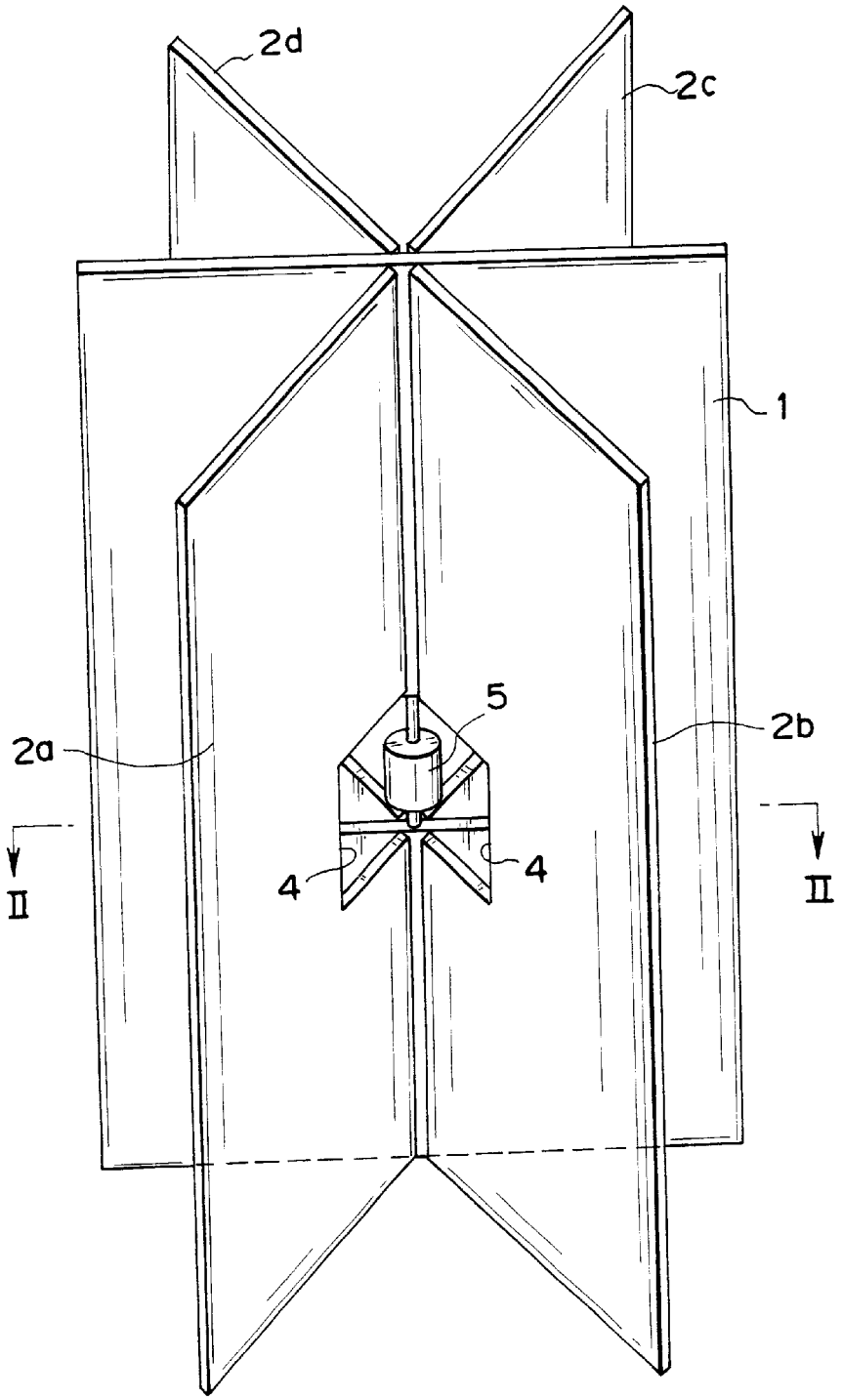
FIG. 1 is a perspective view of a room interior partition in accordance with an embodiment of the present invention.
Figure 2:
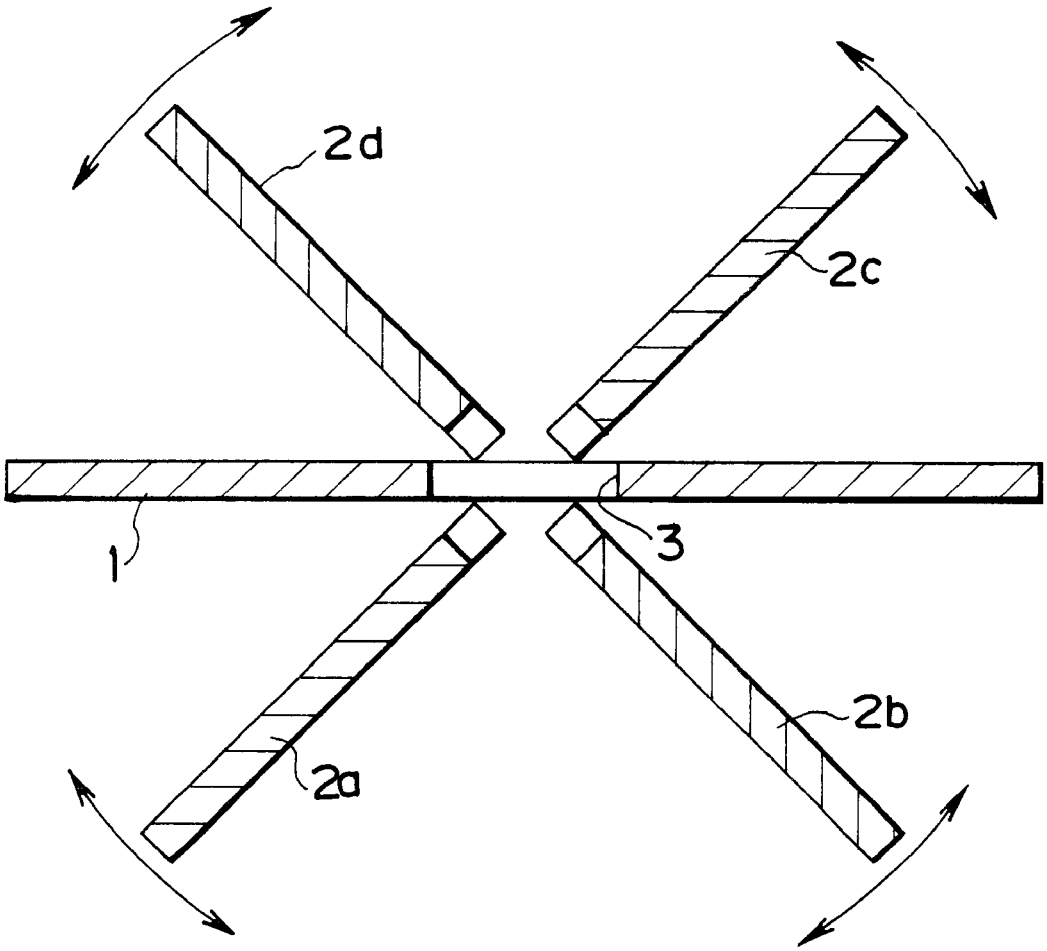
FIG. 2 is a vertical cross-section taken along the lines II—II in FIG. 1.

Specifically referring to FIG. 1 and FIG. 2, a room interior partition embodying the present invention comprises a main panel 1 and four panels 2*a*–2*d* each being hinged to the center axis of main panel 1 (no hinge members are shown in FIG. 1). Main panel 1 is relatively wide and panels 2*a*–2*d* has a width substantially half of main panel 1. Main panel 1 has a square central opening 3 along the center axis thereof, whereas each half-width panel 2*a*–2*d* has a rectangular cutout 4 along a hinged one of opposite vertical edges. Cutouts 4, 4 of opposite half-width panels cooperate each other to form a square opening that is equivalent to opening 3 of main panel 1. For example, panels 2*a* and 2*b* have cutouts 4, 4 which are adjacent to each other to form a square opening, when these panels are aligned as shown in FIGS. 1 and 2. Likewise, panels 2*c* and 2*d* have cutouts 4, 4 which are adjacent to each other to form a square opening, when these panels are aligned. By only way of example, each panel 1, 2*a*–2*d* is made from a veneer of 1 mm thickness and may be surface-finished by coating, printing or with any desired decorative sheet material such as a sliced veneer, printed paper, resin-impregnated paper, etc. Main panel 1 may have a 40 cm ×40 cm opening 3, in which case the size of cutout 4 of half-width movable panel 2*a*–2*d* is 20 cm (in width) ×40 cm (in height).

A single lighting fixture 5 is fitted to main panel 1 along the center axis. Any kind of the lighting fixture may be used and fitted in any known attachment technique. However, it is preferable that lighting fixture 5 is substantially cylindrical or spherical and fitted to main panel 1 in such a manner that a vertical axis of lighting fixture 5 is in exact alignment with the center axis of main panel 1. With this arrangement, lighting fixture 5 may illuminate evenly and simultaneously the room sections divided by panels 1, 2*a*–2*d*.

Since half-width panels 2*a*–2*d* is hinged to main panel 1, each panel may be rotated as shown by arrows in FIG. 2 to radiate at a desired angle with respect to the vertical plane of main panel 1. This allows a wider choice to the user in dividing the original room interior into plural sections. Further, when a pair of half-width movable panels 2*a* and 2*d* are folded onto one surface of main panel 1 and another pair of half-width movable panels 2*b* and 2*c* are folded onto another surface of main panel 1, there is in fact only one partition wall that divides the original room interior into exact halves.

It is to be understood that FIGS. 1 and 2 illustrates the brief outline of the room interior partition embodying the present invention and omits details which do not directly relate to the characteristic features of the present invention. The size of panels 1, 2*a*–2*d* depends on the user's choice. Opening 3 of panel 1 and the cutouts 4 of panels 2*a*–2*d* may have desired shape and size.

Figure 3:
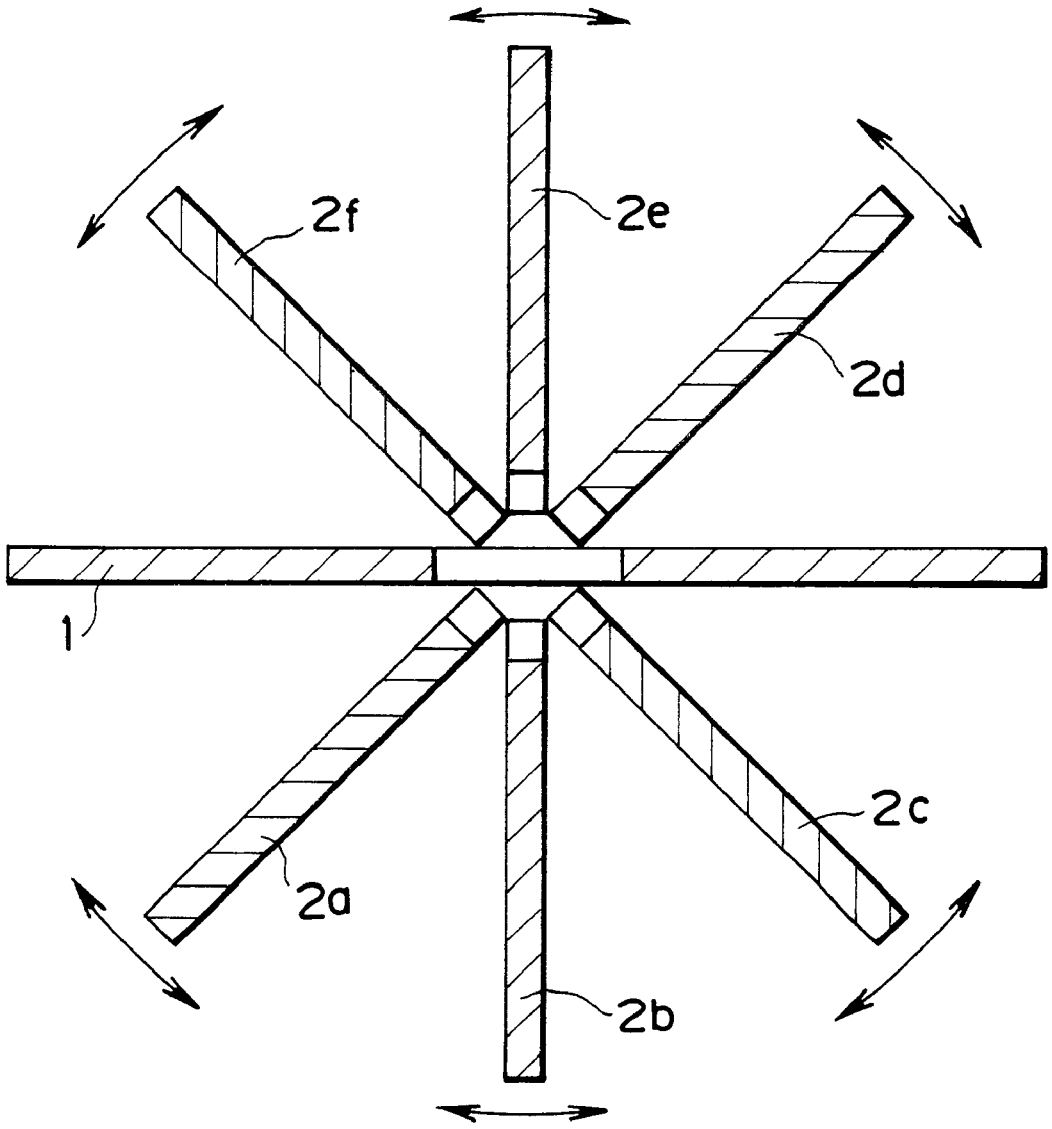
FIG. 3 is a vertical cross-section, similar to FIG. 2, showing the room interior partition in accordance with a modified embodiment of the present invention.

The number of panels 2*a*–2*d* may be changed as desired by the user. In a modified embodiment shown in FIG. 3, three half-width panels 2*a*–2*c* are hinged to the center axis of main panel 1 at one surface thereof, whereas three half-width panels 2*d*–2*f* are likewise hinged to the center axis of main panel 1 at another surface thereof.

Figure 4:
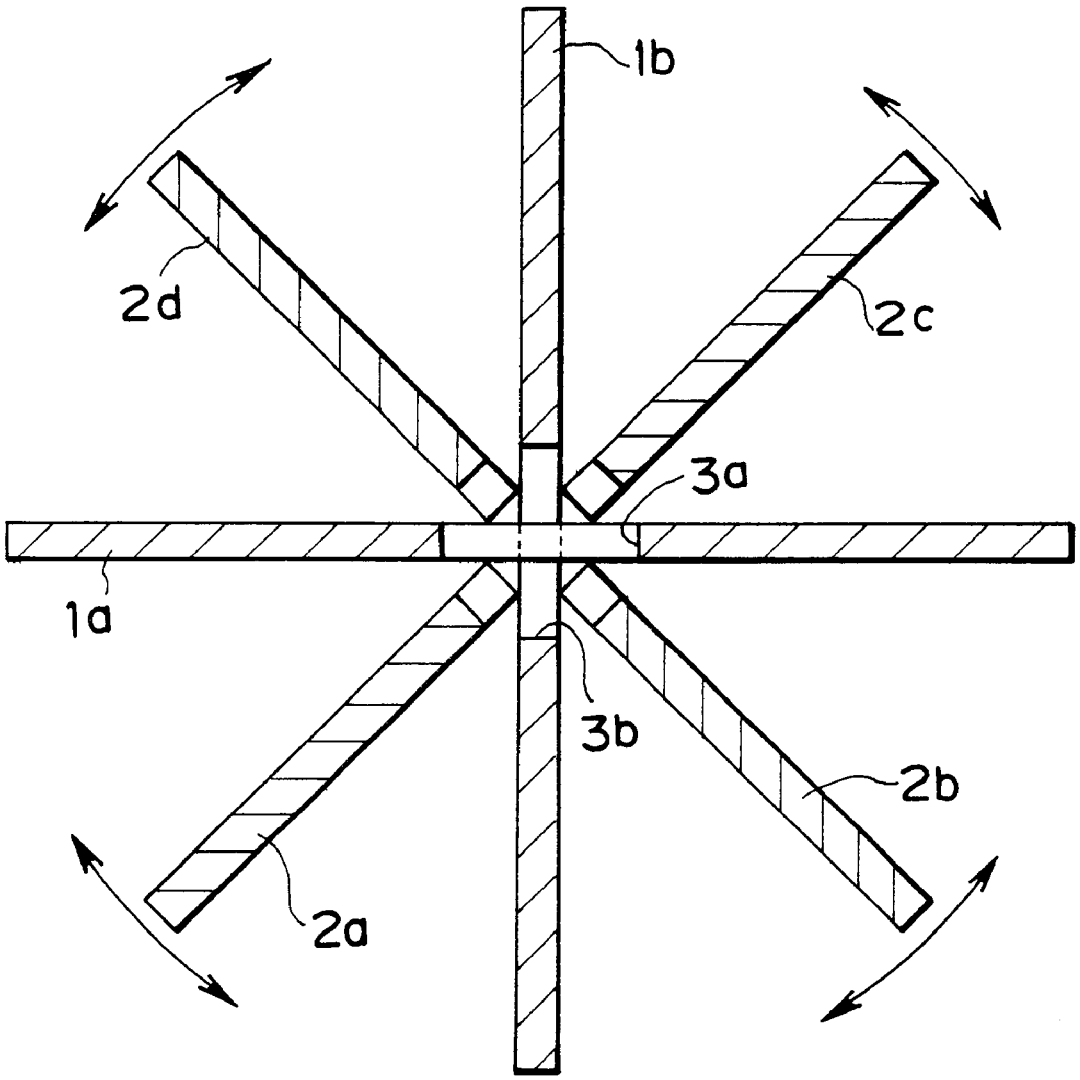
FIG. 4 is a vertical cross-section, similar to FIG. 2, showing the room interior partition in accordance with a still modified embodiment of the present invention.

In still another modified embodiment shown in FIG. 4, a pair of main panels 1*a* and 1*b*, having openings 3*a* and 3*b* at their center axes respectively, intersect with one another at right angles to provide a cruciform partition structure, dividing the original room interior into fixed four sections of equal angle of 90 degrees. Each of the fixed sections may further be divided into two sections by hinged half-width panels 2*a*–2*d*. Each panel 2*a*–2*d* may be folded along the surface of main panel 1*a* or 1*b* so that the fixed sections of 90 degrees angle may remain without being further divided.

Although the present invention has been described in connection with a specific embodiment thereof, it should be understood that the present invention has various modifications and variations within a scope of invention that is defined in the appended claims.

What is claimed is:

1. A room interior partition comprising one or more of wall panels, connected to one another, said wall panels being upstanding from a floor toward a ceiling of an original room interior over a predetermined height, each of said wall panels including an opening along a common vertical axis; and a single lighting fixture mounted within a space defined by cooperation of said openings of said wall panels for illuminating, at the same time, all of room sections divided by said wall panels.

2. A room interior partition comprising at least one main wall panel with an opening along a predetermined vertical axis thereof, said main wall panel being upstanding from a floor toward a ceiling of an original room interior over a predetermined height; one or more of movable panels having one vertical edge pivottaly connected to the predetermined vertical axis of said main wall panel, each of said movable panels having a cutout along the connected vertical edge that cooperates with another cutout of an opposed movable panel to form an opening equivalent to said opening of said main panel; and a single lighting fixture mounted within a space defined by cooperation of said opening of said main wall panel and said cutouts of said movable panel for illuminating, at the same time, all of room sections divided by said main wall panel and movable panels.

3. A room interior partition according to claim 2 wherein each of said movable panels have width substantially a half of said main panel.

4. A room interior partition according to claim 2 wherein each of said movable panels is foldable onto one of opposite surfaces of said main panel.

5. A room interior partition according to claim 2 wherein there are two main wall panels that intersect one another at right angles to divide the original room interior into four sections, between which at least one of said movable panels are respectively positioned.

* * * * *